US011192126B2

(12) United States Patent
Shim et al.

(10) Patent No.: US 11,192,126 B2
(45) Date of Patent: Dec. 7, 2021

(54) DISPENSER CONTAINER HAVING RETRACTABLE NOZZLE

(71) Applicant: NEST-FILLER PKG CORPORATION, Bucheon-si (KR)

(72) Inventors: Yoon Seog Shim, Bucheon-si (KR); Sung Hwan Kang, Gwangmyeong-si (KR)

(73) Assignee: NEST-FILLER PKG CORPORATION, Bucheon-si (KR)

( * ) Notice: Subject to any disclaimer, the term of this patent is extended or adjusted under 35 U.S.C. 154(b) by 0 days.

(21) Appl. No.: 16/967,173

(22) PCT Filed: Nov. 27, 2019

(86) PCT No.: PCT/KR2019/016465
§ 371 (c)(1),
(2) Date: Aug. 4, 2020

(87) PCT Pub. No.: WO2020/130395
PCT Pub. Date: Jun. 25, 2020

(65) Prior Publication Data

US 2021/0299682 A1 Sep. 30, 2021

(30) Foreign Application Priority Data

Dec. 17, 2018 (KR) ..... 10-2018-0163326

(51) Int. Cl.
*B05B 11/00* (2006.01)
*B05B 1/30* (2006.01)
(Continued)

(52) U.S. Cl.
CPC ..... *B05B 1/30* (2013.01); *B05B 11/3001* (2013.01); *B05B 11/3042* (2013.01); *B65D 77/048* (2013.01); *B65D 83/005* (2013.01)

(58) Field of Classification Search
CPC ..... B05B 11/0038; B05B 11/0032; B05B 11/3059; B05B 11/00416; B05B 1/30;
(Continued)

(56) References Cited

U.S. PATENT DOCUMENTS 3,371,827 A * 3/1968 Micallef ..... B65D 47/2012 222/507
4,779,773 A * 10/1988 Bennett ..... B65D 47/2012 215/313
(Continued)

FOREIGN PATENT DOCUMENTS

JP 2015143114 8/2015
JP 2015221677 12/2015
(Continued)

*Primary Examiner* — Vishal Pancholi
*Assistant Examiner* — Robert K Nichols, II
(74) *Attorney, Agent, or Firm* — Lex IP Meister, PLLC

(57) ABSTRACT

A dispenser container having a retractable nozzle is proposed. The container is configured such that an air pumping part (30) is coupled and secured to an upper portion of a container body (10) by a locking cap (20), a guide cap (20) configured to be movable up and down is coupled to the outer surface of the locking cap (20) at a location outside the locking cap, and a nozzle cap (50) configured to pressurize and operate the air pumping part while being rotated and being moved up and down in conjunction with the guide cap is coupled to an upper portion of the guide cap (40) at a location outside the guide cap so that the nozzle (60) coupled to the nozzle coupling hole formed at the side of the nozzle cap is extended and retracted in response to the rotation of the nozzle cap.

3 Claims, 9 Drawing Sheets

(51) Int. Cl.
*B65D 77/04* (2006.01)
*B65D 83/00* (2006.01)

(58) Field of Classification Search
CPC ..... B05B 11/3001; B05B 11/3042; B05B 11/0091; B05B 15/65; A45D 40/00; G01F 11/025; B65D 47/2012; B65D 83/0033; B65D 77/048; B65D 83/005; B65D 83/22; B65D 83/56
USPC ..... 222/531, 387, 382, 340, 153.13, 250, 222/534, 321.9
See application file for complete search history.

(56) References Cited

U.S. PATENT DOCUMENTS 5,016,783 A * 5/1991 Hayes ..... B05B 11/0032 222/153.13
2018/0361413 A1* 12/2018 Ruan ..... B05B 11/0032

FOREIGN PATENT DOCUMENTS

KR 101795444 11/2017
KR 10-1922243 11/2018
KR 10-1966154 4/2019
KR 101966154 4/2019

* cited by examiner

DISPENSER CONTAINER HAVING RETRACTABLE NOZZLE

TECHNICAL FIELD

The present invention relates generally to a dispenser container having a retractable nozzle, the container being used by causing the nozzle to be extended and retracted in response to rotation of a nozzle cap. More particularly, the present invention relates to a dispenser container having a retractable nozzle, wherein the nozzle is extended and retracted in response to rotation of a nozzle cap by engagement between a nozzle coupling hole formed at a side of the nozzle cap and the nozzle inserted into the nozzle coupling hole, wherein a through-hole vertically formed in the nozzle is moved from an offset position to an aligned position with respect to a vertical discharge hole of the nozzle cap, thereby allowing contents to be discharged, and the through-hole is moved from the aligned position to the offset position with respect to the vertical discharge hole of the nozzle cap, thereby blocking discharge of the contents.

BACKGROUND ART

In general, a dispenser container is used for storing and discharging various contents such as cosmetics, perfumes, and medicines.

The dispenser container is mainly configured such that an air pumping part provided on a container body is secured by a locking cap, and a nozzle cap is provided on the air pumping part, whereby contents of the nozzle cap are discharged for use by means of a pumping operation of the air pumping part operated in response to pressurization of the nozzle cap.

The conventional dispenser container as described above is characterized in that the nozzle is provided as a fixed type protruding or not protruding from the side of the nozzle cap. Therefore, in the case of the non-protruding nozzle, the contents discharged from the nozzle may flow along the container thereby contaminating the container, and it may be inconvenient to use the contents by applying the contents onto the back of a user's hand. On the contrary, in the case of the protruding nozzle, it may be difficult to combine a finishing cap to the nozzle, and an external appearance of the container may be spoiled.

In an effort to solve the above problems of the related art, there have been disclosed a number of dispenser containers having retractable nozzles. An example of these has been disclosed in Korean Patent No. 10-1218741. A container disclosed therein includes: a pumping member coupled to an upper portion of a container body; a button part is coupled to an upper portion of the pumping member, the button part including a button cap and a button body that are coupled to each other at upper and lower positions and an upper portion of the pumping member and a nozzle locking portion formed at an eccentric position of the bottom body and to which a flexible nozzle is coupled; and a rotary body is coupled to the container body at a location outside the pumping member, wherein a front end of a nozzle part is inserted into a nozzle access mouth of the rotary body so that the position of the nozzle access mouth of the rotary body is varied by forward and reverse rotation of the rotary body, thereby causing the flexible nozzle to be operated to retractably pass through the nozzle access mouth forward and rearward. Another example is disclosed in Korean Utility Model Registration No. 20-0440940. A container disclosed herein includes: a container body having an opening formed in an upper portion thereof and an accommodating space formed therein; a pumping part disposed in the opening to protrude outward of the opening and including a discharge portion formed at an upper portion thereof; a discharge part configured to discharge contents of the accommodating space discharged from the pumping part when a pressing member is pressurized, and including a rotary cap, a locking member, a head, and the pressing member sequentially coupled to an upper portion of the pumping part; a locking cap supporting and securing the pressing member while surrounding the pressing member so that an upper end of the pressing member protrudes outward of the locking cap, and having an upper surface and an outer circumferential surface respectively provided with an operating hole and a discharge hole; and a rotary member coupled to the rotary cap and configured to rotate the rotary cap, wherein the rotary cap is rotated to cause a door provided at the rotary cap to open and close the discharge hole of the locking cap while causing a discharge portion of the head, through which the contents are discharged, to protrude outward through the discharge hole and then to be inserted inward therethrough, thereby preventing damage to the discharge portion and preventing foreign matter from adhering to the discharge portion. However, the above related-art dispenser containers with retractable nozzles have a complicated assembly structure and an operating structure for parts for nozzle extension/retraction or parts for nozzle hole blocking, which may lead to increasing manufacturing costs, decreasing manufacturing productivity, and decreasing product reliability such as the nozzle is not extended and retracted efficiently.

On the other hand, a technique for improving the related-art dispenser containers with retractable nozzles has been disclosed in Korean Patent No. 10-1795444, filed and registered by the applicant of the present invention. A container disclosed herein is configured such that an air pumping part provided on a container body is secured by a locking cap, and a nozzle cap is provided on the air pumping part and is configured to be rotated to cause a nozzle to be extended and retracted, wherein the nozzle includes a fixed nozzle integrally and fixedly formed on one side of an inner surface of the nozzle cap and a retractable nozzle inserted into a front side of the fixed nozzle, and the nozzle is configured such that by a cam operation in which a cam guide groove formed in a lower portion of the retractable nozzle is guided by a cam protrusion when the nozzle cap is rotated, the retractable nozzle is extended out of the side of the locking cap. Therefore, with such a simple structure, operation reliability is increased compared to the related art.

However, in the above-mentioned technology filed by the applicant of the present invention, due to a structure in which the nozzle includes the retractable nozzle and the fixed nozzle coupled to each other to be located at inner and outer positions, discharge of the contents, opening and closing operations of the nozzle, and an airtight operation may not be efficiently performed. Additionally, due to the fact that the nozzle structure is complicated and the nozzle cap to which the nozzle is coupled is formed as a single body, molding and assembling of the nozzle may be vulnerable. Therefore, research efforts have been made to develop a product that further improves productability while solving such problems by preventing malfunctions when discharging the contents during use and when storing the container during non-use.

DISCLOSURE

Technical Problem

Accordingly, the present invention has been made keeping in mind the above problems occurring in the related art, and an objective of the present invention is to provide a dispenser container having a retractable nozzle, wherein the nozzle is extended and retracted in response to rotation of a nozzle cap by engagement between a nozzle coupling hole formed at a side of the nozzle cap and the nozzle inserted into the nozzle coupling hole, wherein a through-hole vertically formed in the nozzle is moved from an offset position to an aligned position with respect to a vertical discharge hole of the nozzle cap, thereby allowing contents to be discharged, and the through-hole is moved from the aligned position to the offset position with respect to the vertical discharge hole of the nozzle cap, thereby blocking discharge of the contents. Therefore, with this simple structure, manufacturing productivity, economic efficiency, operational reliability, and productability are greatly improved compared to the related art.

Another objective of the present invention is to provide a dispenser container having a retractable nozzle, wherein a nozzle cap includes an inner cap and an outer cap separately provided and coupled to each other, whereby forming of a nozzle coupling hole and a vertical discharge hole or assembly of parts such as a nozzle and a sealing sheet is easily achieved while greatly improving assembly productivity.

Still another objective of the present invention is to provide a dispenser container having a retractable nozzle, wherein a container body includes an inner cylinder and an outer cylinder so that the inner cylinder is moved up in response to rotation of the outer cylinder, allowing a nozzle cap to come into a pressable state to discharge contents, whereby malfunctions are prevented to greatly improve marketability.

Technical Solution

The present invention provides a dispenser container having a retractable nozzle, the container including: a container body; a locking cap coupled to an upper portion of the container body; an air pumping part coupled and secured to the upper portion of the container body by the locking cap, and configured to discharge contents; a guide cap coupled to an upper portion of the locking cap at a location outside the locking cap and configured to be movable up and down, and having an upper portion provided with a guide protrusion formed helically; a nozzle cap coupled to an upper portion of the guide cap at a location outside the guide cap and configured to pressurize and operate the air pumping part while being rotated and being moved up and down in conjunction with the guide cap, and including a vertical discharge hole centrally formed therein and a nozzle coupling hole horizontally extending from one side of an upper portion of the vertical discharge hole to be in communication therewith; and a nozzle inserted into the nozzle coupling hole of the nozzle cap, having a lower portion provided with a guide groove to which the guide protrusion of the guide cap is inserted, and configured to be extended out of and retracted into the nozzle coupling hole of the nozzle cap in a guide operation by rotation of the nozzle cap, the nozzle including a nozzle hole horizontally formed therein and a through-hole vertically extending from an inner lower portion of the horizontal nozzle hole to be in communication therewith so that during extension of the nozzle, the through-hole may be moved from an offset position to an aligned position with respect to the vertical discharge hole of the nozzle cap, thereby allowing the contents to be discharged, and during retraction of the nozzle, the through-hole may be moved from the aligned position to the offset position with respect to the vertical discharge hole of the nozzle cap, thereby blocking discharge of the contents.

According to the present invention, a stepped recess may be formed above the vertical discharge hole of the nozzle cap, and a sealing sheet having an auxiliary vertical discharge hole formed at a position corresponding to the vertical discharge hole may be inserted into the stepped recess to be in tight contact with the through-hole of the nozzle thereby providing a seal of the through-hole.

According to the present invention, the nozzle cap may include an outer cap, and an inner cap configured such that the vertical discharge hole and the stepped recess are centrally formed in an upper portion thereof and a nozzle coupling groove is formed at one side thereof; and the nozzle cap may be configured such that the outer and inner caps are separately provided from each other and the outer cap is coupled to the inner cap with the nozzle and the sealing sheet being coupled to the upper portion of the inner cap.

According to the present invention, the container body may include an inner cylinder in which the contents are stored and an outer cylinder fitted over an outer surface of the inner cylinder, and the container body may be configured such that the inner and outer cylinders are coupled to each other to be rotatable with respect to each other, wherein a guide pin may protrude from an upper portion of an outer surface of the inner cylinder, and an inclined guide path along which the guide pin is guided may be circumferentially formed on an inner surface of the outer cylinder so that when the inner cylinder is moved up or down in response to rotation of the outer cylinder, the nozzle cap may be moved with respect to an upper portion of the outer cylinder from a spaced-apart position to a seated position or from the seated position to the spaced-apart position, thereby allowing the nozzle cap to come into a pressable state or a non-pressable state.

Advantageous Effects

In the present invention configured as described above, an air pumping part is coupled and secured to an upper portion of a container body by a locking cap, a guide cap configured to be movable up and down is coupled to an outer surface of the locking cap at a location outside the locking cap, and a nozzle cap configured to pressurize and operate the air pumping part while being rotated and being moved up and down in conjunction with the guide cap is coupled to an upper portion of the guide cap at a location outside the guide cap so that a nozzle coupled to a nozzle coupling hole formed at a side of the nozzle cap is extended and retracted in response to rotation of the nozzle cap, wherein during extension of the nozzle, a through-hole extending from an inner lower portion of a nozzle hole is moved from an offset position to an aligned position with respect to a vertical discharge hole formed in the nozzle cap, thereby allowing contents to be discharged; and during retraction of the nozzle, the through-hole extending from the inner lower portion of the nozzle hole is moved from the aligned position to the offset position with respect to the vertical discharge hole of the nozzle cap, thereby blocking discharge of the contents. Therefore, with this simple structure, it is possible to greatly improve manufacturing productivity, economic efficiency, operational reliability, and productability compared to the related art.

Further, the nozzle cap includes an inner cap and an outer cap separately provided and coupled to each other, whereby it is possible to easily achieve forming of the nozzle coupling hole and the vertical discharge hole or assembly of parts such as the nozzle and a sealing sheet while greatly improving assembly productivity; and the container body includes an inner cylinder and an outer cylinder so that the inner cylinder is moved up in response to rotation of the outer cylinder, allowing the nozzle cap to come into a pressable state to discharge contents, whereby it is possible to prevent malfunctions to greatly improve marketability.

BEST MODE

Hereinafter, an exemplary embodiment of the present invention will be described in detail with reference to the accompanying drawings.

Figure 1:
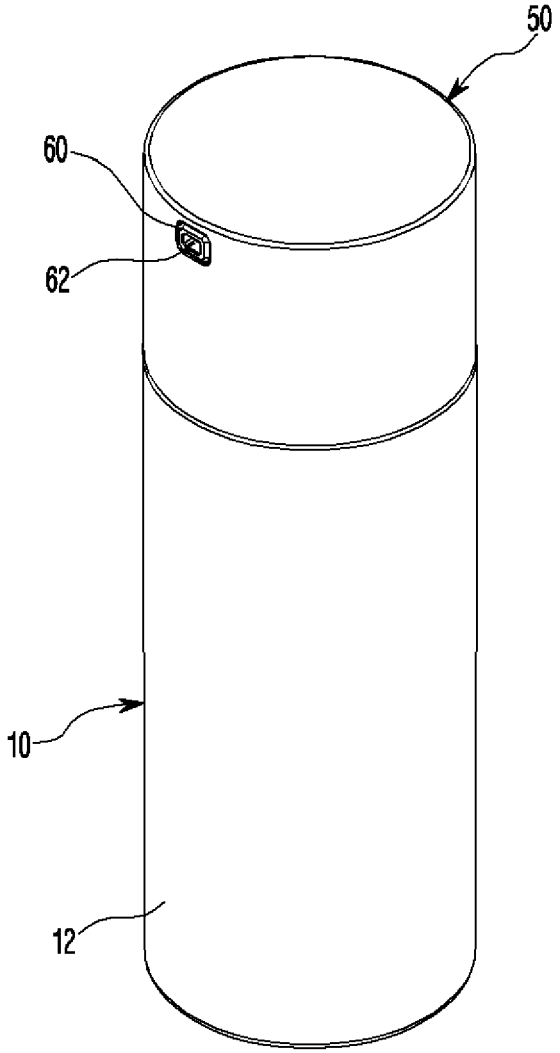
FIG. 1 is an external perspective view illustrating a container according to the present invention.
Figure 2:
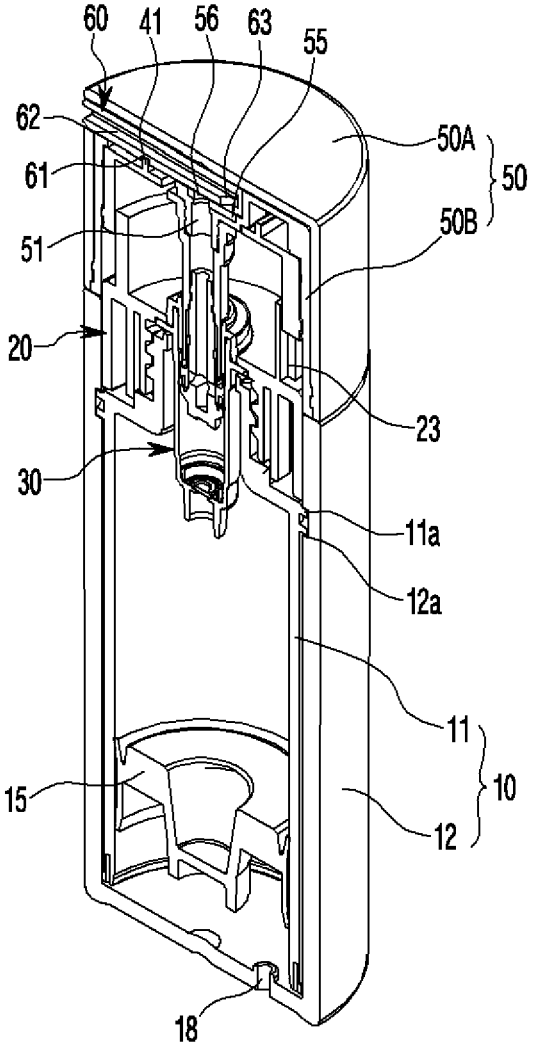
FIG. 2 is a half-sectional perspective view of FIG. 1.
Figure 3:
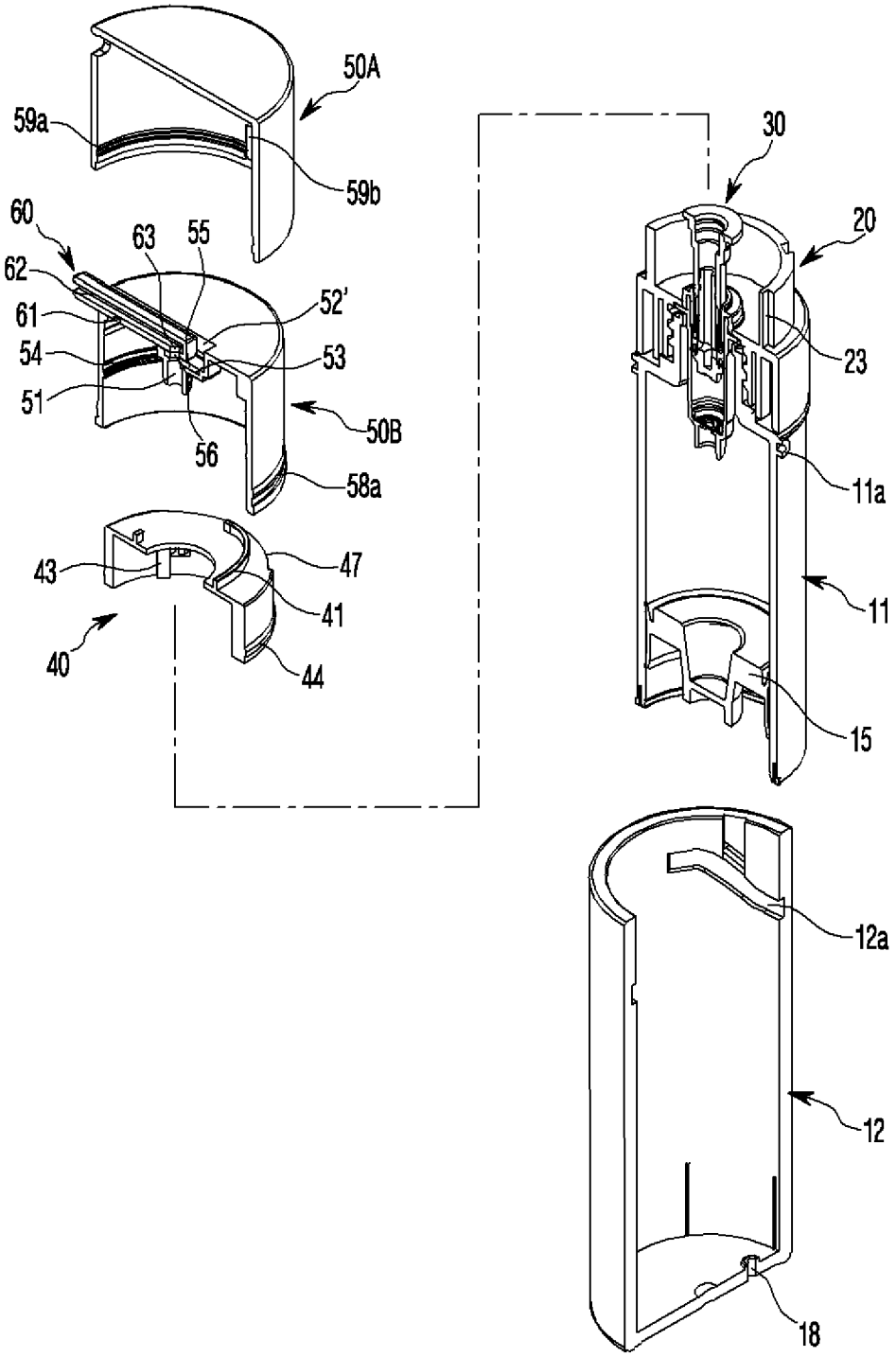
FIG. 3 is a partially exploded perspective view of FIG. 2.
Figure 4:
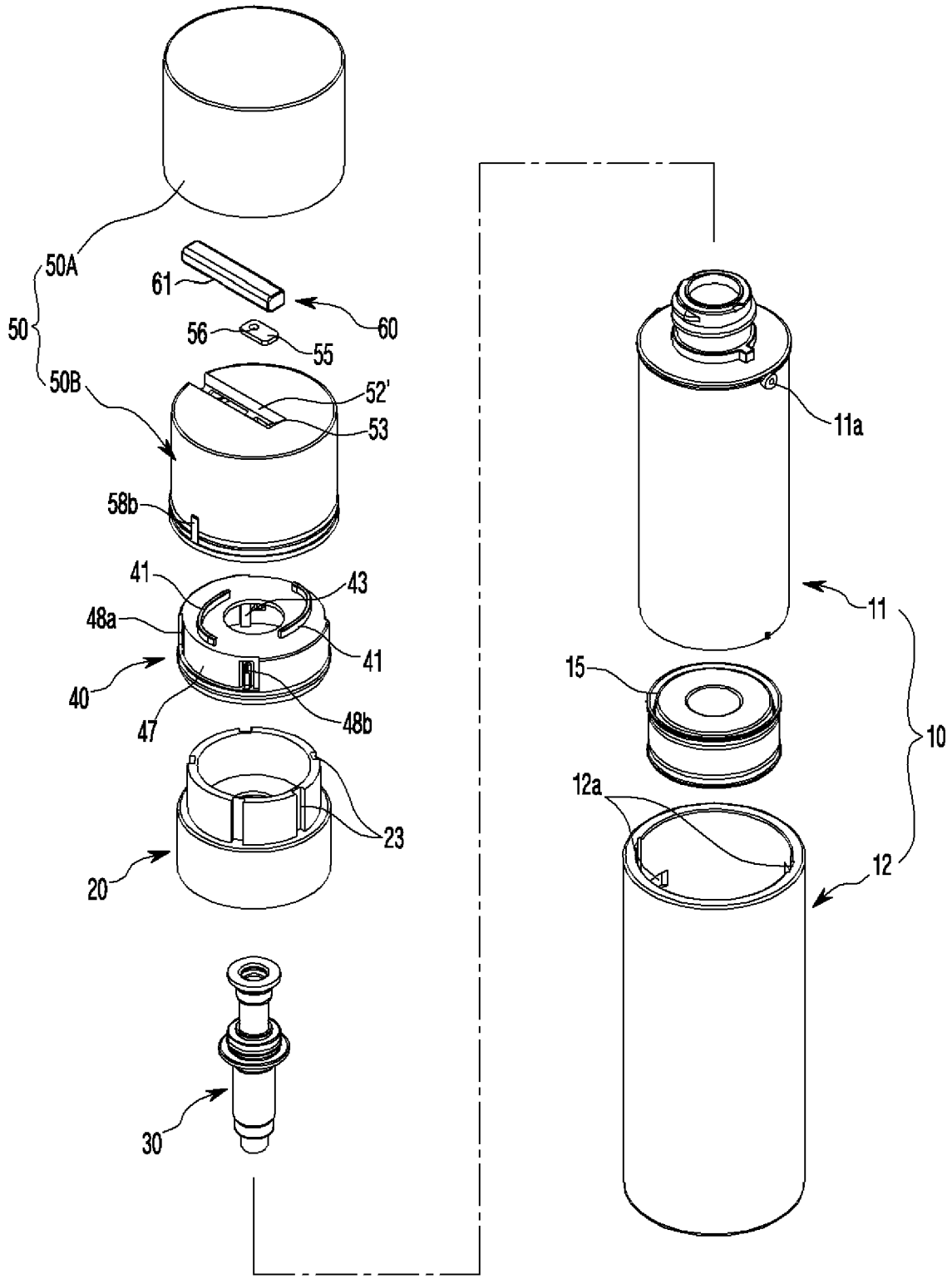
FIG. 4 is an exploded perspective view of FIG. 1.
Figure 5:
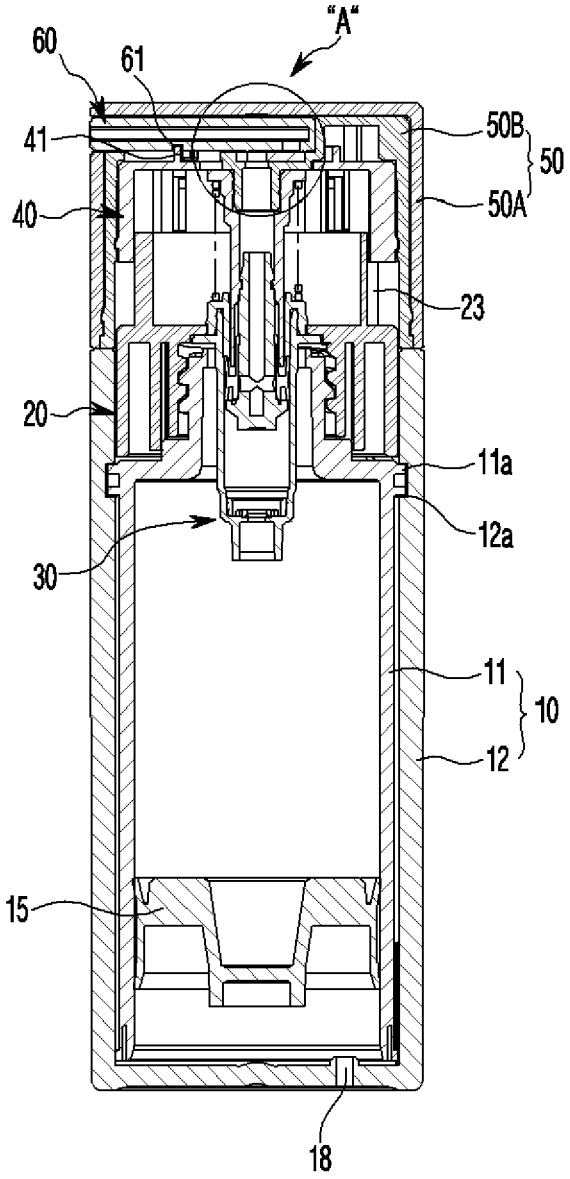
FIG. 5 is a front sectional view of FIG. 2.
Figure 6:
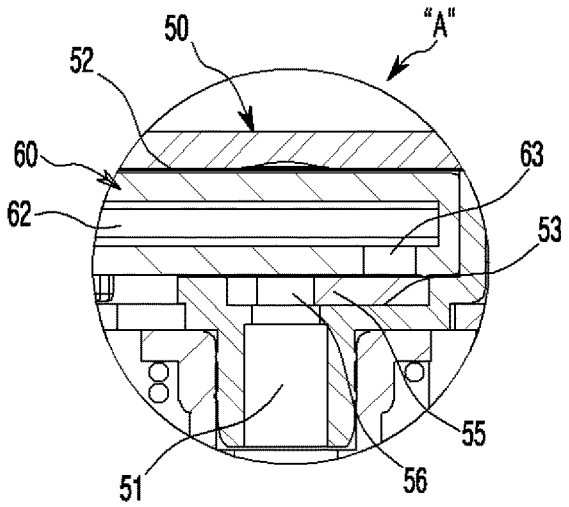
FIG. 6 is an enlarged view of portion "A" illustrated in FIG. 5.
Figure 7:
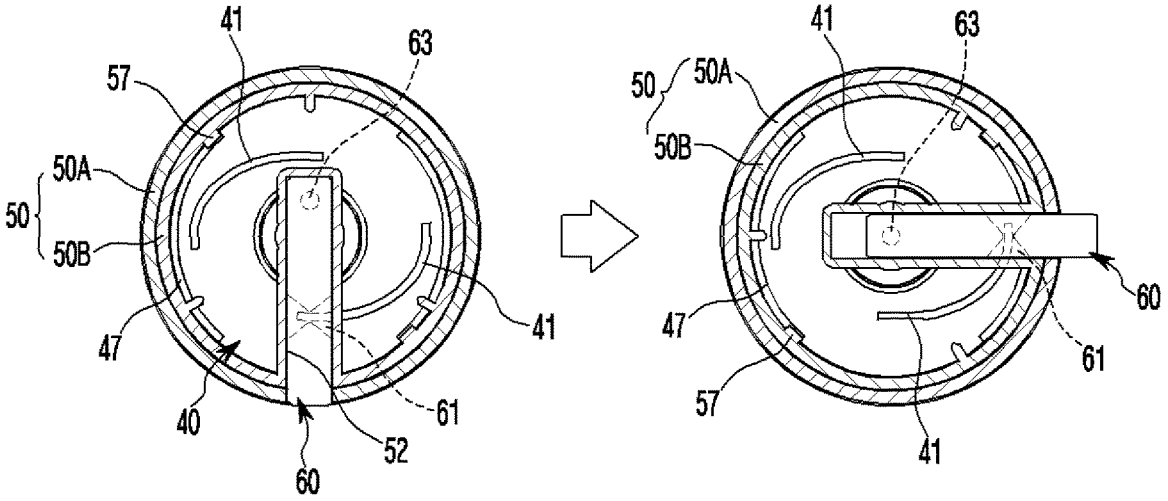
FIG. 7 is a sectional plan view of main parts illustrated in FIG. 1.
Figure 8:
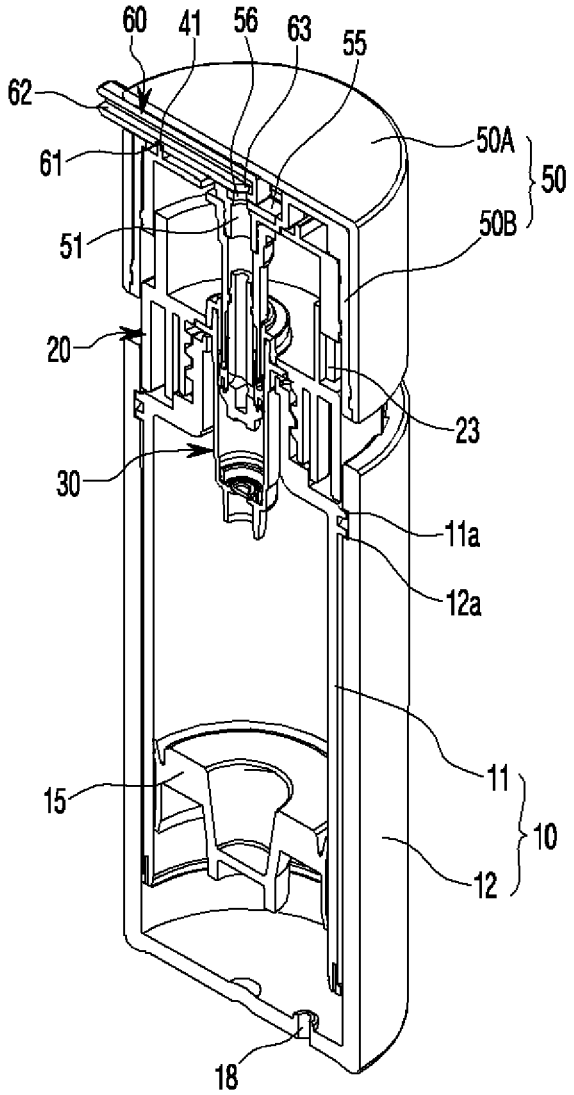
FIG. 8 is a half-sectional perspective view illustrating a protruding state of a nozzle illustrated in FIG. 2.
Figure 9:
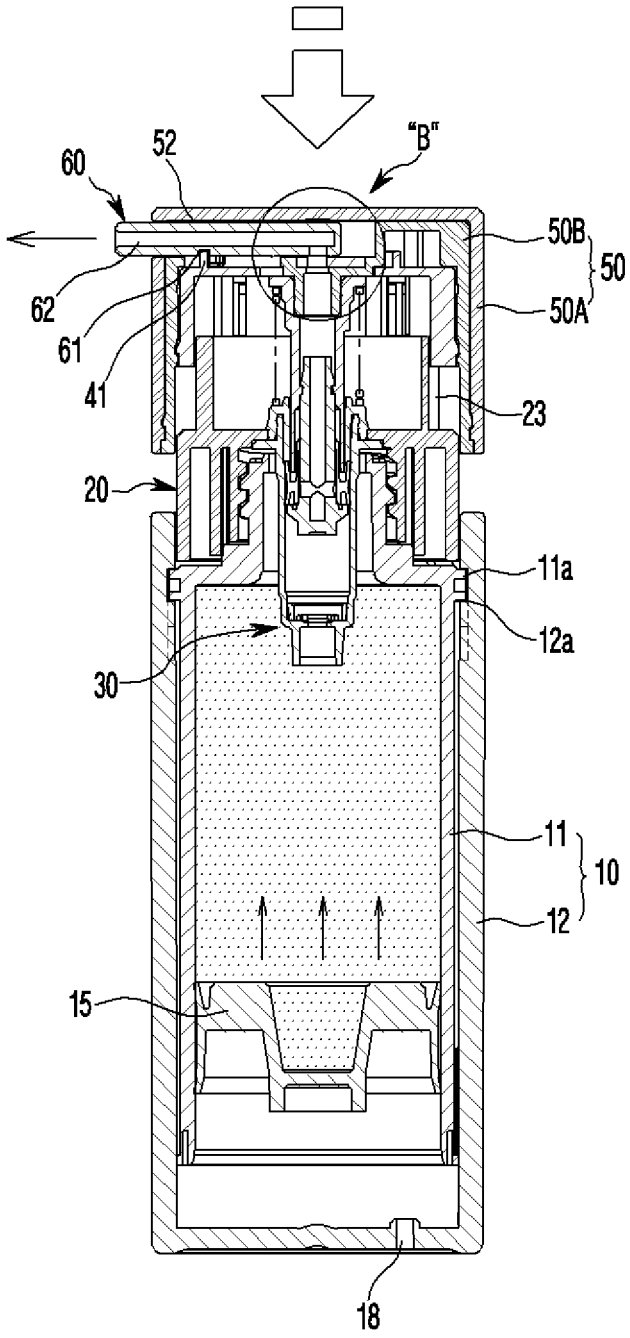
FIG. 9 is a front sectional view of FIG. 8.
Figure 10:
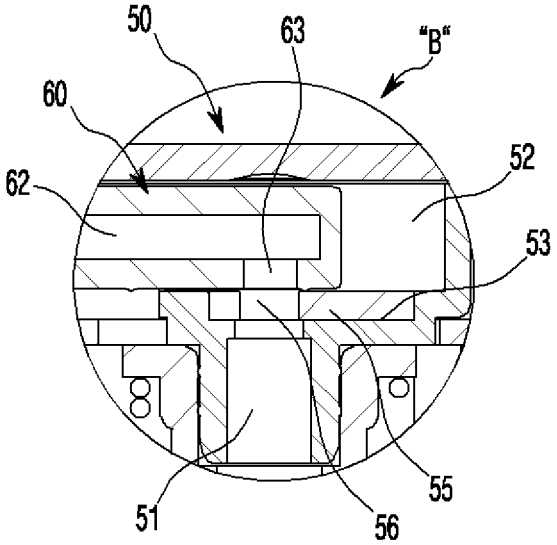
FIG. 10 is an enlarged view of portion "B" illustrated in FIG. 9.

As illustrated in FIGS. 1 to 10, a dispenser container having a retractable nozzle according to the present invention includes a container body 10, a locking cap 20, an air pumping part 30, a guide cap 40, a nozzle cap 50, and a nozzle 60.

The container body 10 is configured to store contents therein and is configured such that the air pumping part 30 is seated on an upper portion of the container body 10 so as to be partially inserted into the container body 10 and is coupled and secured to the container body 10 by the locking cap 20 screwed to the upper portion of the container body 10.

The air pumping part 30 is configured to discharge the contents inside the container body 10 by performing a pumping operation, wherein the contents are discharged by upward movement of a piston 15 provided inside the container body 10.

The guide cap 40 is coupled to an upper portion of the locking cap 20 at a location outside the locking cap 20 and is configured to be movable up and down, wherein the guide cap 40 is movable up and down by engagement between a vertical protrusion 43 formed on an inner surface of the guide cap 40 and a vertical groove 23 formed in the outer surface of the locking cap 20.

Further, the guide cap 40 has an upper portion provided with one guide protrusion 41 formed helically, or two guide protrusions 41 formed helically at equiangular positions.

Here, the guide protrusion 41 is configured to form a helical curve that extends outward from the center of the upper portion of the guide cap 40 at an angle in the range of 90°, wherein the helical curve is displaced by a protruding distance of a nozzle.

The nozzle cap 50 is coupled to an upper portion of the guide cap 40 at a location outside the guide cap 40 and is configured to pressurize and operate the air pumping part 30 while being rotated and being moved up and down in conjunction with the guide cap 40. Further, the nozzle cap 50 includes a vertical discharge hole 51 centrally formed therein and a nozzle coupling hole 52 horizontally extending from one side of an upper portion of the vertical discharge hole 51 to be in communication therewith.

Here, the nozzle cap 50 is moved up and down in conjunction with the guide cap 40 by engagement between an annular groove 54 circumferentially formed in an inner surface of the nozzle cap 50 and an annular protrusion 44 circumferentially formed on a lower portion of an outer surface of the guide cap 40 and inserted into the annular groove 54. Further, the nozzle cap 50 is rotated in the range of 90° by engagement between a vertical guide groove 47 circumferentially formed in the outer surface of the guide cap 40 in the direction of rotation and a vertical guide protrusion 58 formed on the inner surface of the nozzle cap 50 and inserted into the vertical guide groove 47.

The nozzle 60 is inserted into the nozzle coupling hole 52 of the nozzle cap 50, has a lower portion provided with a guide groove 61 to which the guide protrusion 41 of the guide cap 40 is inserted, and is configured to be extended out of and retracted into the nozzle coupling hole 52 of the nozzle cap 50 in a guide operation by rotation of the nozzle cap 50. Here, the nozzle 60 includes a nozzle hole 62 horizontally formed therein and a through-hole 63 vertically extending from an inner lower portion of the horizontal nozzle hole 62 to be in communication therewith so that during extension of the nozzle 60, the through-hole 63 is moved from an offset position to an aligned position with respect to the vertical discharge hole 51 of the nozzle cap 50, thereby allowing the contents to be discharged; and during retraction of the nozzle 60, the through-hole 63 is moved from the aligned position to the offset position with respect to the vertical discharge hole 51 of the nozzle cap 50, thereby blocking discharge of the contents.

Here, a stepped recess 53 is formed above the vertical discharge hole 51 of the nozzle cap 50, and a sealing sheet 55 having an auxiliary vertical discharge hole 56 formed at a position corresponding to the vertical discharge hole 51 is inserted into the stepped recess 53 to be in tight contact with the through-hole 63 of the nozzle 60 thereby providing a seal of the through-hole 63.

Further, the nozzle cap 50 includes an outer cap 50A and an inner cap 50B separately provided from each other for formability and assemblability and coupled to each other to be located at inner and outer positions, wherein an annular protrusion 58*a* circumferentially formed on a lower portion of an outer surface of the inner cap 50B is inserted into an annular groove 59*a* circumferentially formed in a lower portion of an inner surface of the outer cap 50A so as to prevent separation between the outer and inner caps 50A and 50B, and a vertical protrusion 58*b* formed on the lower portion of the outer surface of the inner cap 50B is inserted into a vertical groove 59*b* formed in the lower portion of the inner surface of the outer cap 50A so as to prevent left and right rotation of the outer and inner caps 50B and 50A.

Here, the inner cap 50B is configured such that the vertical discharge hole 51 and the stepped recess 53 are centrally formed in an upper portion thereof, a nozzle coupling groove 52' is formed at one side thereof, and the outer cap 50A is coupled to the inner cap 50B with parts such as the nozzle 60 and the sealing sheet 55 being coupled to the upper portion of the inner cap 50B.

Further, the container body 10 includes an inner cylinder 11 in which the contents are stored and an outer cylinder 12 fitted over an outer surface of the inner cylinder 11, and the container body 10 is configured such that the inner and outer cylinders 11 and 12 are coupled to each other to be rotatable with respect to each other, wherein a guide pin 11*a* protrudes from an upper portion of an outer surface of the inner cylinder 11, and an inclined guide path 12*a* along which the guide pin 11*a* is guided is circumferentially formed on an inner surface of the outer cylinder 12 so that when the inner cylinder 11 is moved up or down in response to rotation of the outer cylinder 12, the nozzle cap 50 is moved with respect to an upper portion of the outer cylinder 12 from a spaced-apart position to a seated position or from the seated position to the spaced-apart position, thereby allowing the nozzle cap 50 to come into a pressable state or a non-pressable state.

That is, when the contents are needed to be discharged for use, the inner cylinder 11 is moved up out of the outer cylinder 12 to a position allowing the pumping operation of the air pumping part 30 by the nozzle cap 50, and after use, the inner cylinder 11 is moved down into the outer cylinder 12 to a position not allowing the pumping operation of the air pumping part 30 by the nozzle cap 50.

On the other hand, in the present invention, it has been described that extension and retraction of the nozzle 60 are realized by rotating the nozzle cap 50 in an angular range of 90°. However, the present invention is not limited thereto. For example, the nozzle cap 50 may be configured to be rotated in an angular range of equal to or less than 90° or equal to or greater than 90° to cause the nozzle 60 to be extended and retracted, and it should be noted that the degree of change in structure and shape belongs to the scope of the present invention.

An unexplained reference numeral 18 denotes an air hole formed in a lower portion of the outer cylinder 12, and unexplained reference numerals 48*a* and 48*b* denote stop protrusions that are respectively formed at opposite sides of the vertical guide groove 47, which is circumferentially formed in the outer surface of the guide cap 40 in the direction of rotation, so as to be tensioned inward and outward to allow the operation of the vertical guide protrusion 57 formed on the inner surface of the nozzle cap 50 to be stopped at a position on each of the opposite sides of the vertical guide groove 47.

Hereinafter, the operation and action of the dispenser container according to the present invention configured as described above will be described.

First, an assembly process of the dispenser container according to the present invention will be described. The outer cylinder 12 is coupled to the outer surface of the inner cylinder 11, then the air pumping part 30 is seated on an upper portion of the inner cylinder 11 to be inserted into the inner cylinder 11, and then the locking cap 20 is screwed to the upper portion of the inner cylinder 11 to secure the air pumping part 30.

Then, the guide cap 40 configured to be movable up and down is coupled to the upper portion of the locking cap 20, and the nozzle cap 50 configured to be rotated and to be moved up and down in conjunction with the guide cap 20 is coupled to the guide cap 20.

In particular, due to the fact that the nozzle cap 50 includes the outer cap 50A and the inner cap 50B separately provided from each other, the vertical discharge hole 51, the stepped recess 53, and the nozzle coupling groove 52' formed in the inner cap 50B are excellent in formability. Additionally, due to the fact that the outer cap 50A is simply fitted over the outer surface of the inner cap 50B, with the sealing sheet 55 being inserted into the stepped recess 53 formed in the upper portion of the inner cap 50*b* and with the nozzle 60 being inserted into the nozzle coupling groove 52', the outer and inner caps 50A and 50B are excellent in assemblability.

Therefore, in the dispenser container according to the present invention assembled as described above, when the outer cylinder 12 located outside the inner cylinder 11 is rotated for discharging the contents for use, the guide pin 11*a* formed on the outer surface of the inner cylinder 11 is guided to be rotated helically along the inclined guide path 12*a* circumferentially formed on the inner surface of the outer cylinder 12, thereby causing the inner cylinder 11 to be moved up out of the outer cylinder 12.

At this time, the nozzle cap 50 positioned in close contact with the upper portion of the outer cylinder 12 is moved to a position spaced apart from the upper portion of the outer cylinder 12 so that a pressing operation of the nozzle cap 50 is allowed.

When the nozzle cap 50 is rotated in this state, the vertical guide protrusion 57 formed on the inner surface of the nozzle cap 50 is guided to be rotated along the vertical guide groove 47 circumferentially formed on the outer surface of the guide cap 40 in the direction of rotation.

At the same time, the guide groove 61 formed in the lower portion of the nozzle 60 inserted into the nozzle coupling hole 52 of the nozzle cap 50 is guided along the guide protrusion 41 formed on the upper portion of the guide cap 40.

That is, as the guide groove 61 formed in the lower portion of the nozzle 60 is guided along the guide protrusion 41 helically extending outward from the center of the guide cap 40, the nozzle 60 is extended out of the nozzle coupling hole 52 of the nozzle cap 50.

At this time, as the nozzle 60 is moved, the through-hole 63 vertically extending from the inner lower portion of the nozzle hole 62 is moved from a position offset from the vertical discharge hole 51 centrally vertically formed in the nozzle cap 50 to a position aligned with the vertical discharge hole 51, thereby allowing a discharge path of the contents to be opened.

When a user presses the nozzle cap 50 in this state, the nozzle cap 50 is moved down from the upper portion of the locking cap 20 in conjunction with the guide cap 40 to cause the air pumping part 20 to be pressurized to perform a pumping operation.

By the pumping operation, the piston 15 provided inside the container body 10 is moved up to cause the contents to be discharged out of the container. At this time, discharge of the contents is made sequentially through the air pumping part 30, the vertical discharge hole 51 of the nozzle cap 50, the through-hole 63 of the nozzle 60, and the nozzle hole 62 of the nozzle 60.

After the contents are discharged for use as described above, when the nozzle cap 50 is rotated in the reverse direction to return to an original position for storage, the guide groove 61 formed in the lower portion of the nozzle 60 is guided along the guide protrusion 41 of the guide cap 40 to cause the nozzle 60 that has been extended to be retracted into the nozzle coupling hole 52 of the nozzle cap 50 to return to an original position.

As the nozzle 60 is retracted into the nozzle coupling hole 52 of the nozzle cap 50 and returns to the original position, the through-hole 63 vertically extending from the inner lower portion of the nozzle hole 62 of the nozzle 60 is moved from a position aligned with the vertical discharge hole 51 centrally vertically formed in the nozzle cap 50 to a position offset from the vertical discharge hole 51, thereby allowing the discharge path of the contents to be blocked to prevent discharge of the contents.

At this time, due to the fact that the stepped recess 53 is formed above the vertical discharge hole 51 centrally vertically formed in the nozzle cap 50 and the sealing sheet 55 having the auxiliary vertical discharge hole 56 formed at a position corresponding to the vertical discharge hole 51 is provided in the stepped recess 53, the sealing sheet 55 is in tight contact with the through-hole 63 of the nozzle 60 at a position where the through-hole 63 of the nozzle 60 is offset from the auxiliary vertical discharge hole 56 of the sealing sheet 55, thereby ensuring a tight airtight seal of the through-hole 63, with the result that leakage of the contents is reliably prevented, and possibility of deterioration of the contents due to air inflow.

After the nozzle 60 is retracted to the original position in the nozzle cap 50 and simultaneously the discharge path of the contents is blocked as described above, the outer cylinder 12 located outside the inner cylinder 11 is rotated in the reverse direction to cause the guide pin 11*a* formed on the outer surface of the inner cylinder 11 to be guided to be moved down helically along the inclined guide path 12*a* of the outer cylinder 12 so that the inner cylinder 11 is moved down and inserted into the outer cylinder 12 to return to an original position.

As the inner cylinder 11 is inserted into the outer cylinder 12, the nozzle cap 50 is moved downward to a position in tight contact with the upper portion of the outer cylinder 12.

Even if the nozzle cap 50 is pressed by the user in this state, the pressing operation of the nozzle cap 50 is not allowed by the outer cylinder 12.

Therefore, the dispenser container according to the present invention is used in such a manner that the outer cylinder 12 is rotated to cause the inner cylinder 11 to be moved up out of the outer cylinder 12, and then the nozzle cap 50 is rotated to cause the nozzle 60 inserted in the nozzle coupling hole 52 formed at a side of the nozzle cap 50 to be extended. Here, during extension of the nozzle 60, the through-hole 63 extending from the inner lower portion of the nozzle hole 62 is moved from the offset position to the aligned position with respect to the vertical discharge hole 51 formed in the nozzle cap 50, thereby allowing the contents to be discharged; and during retraction of the nozzle 60, the through-hole 63 extending from the inner lower portion of the nozzle hole 62 is moved from the aligned position to the offset position with respect to the vertical discharge hole 51 of the nozzle cap 50, thereby blocking discharge of the contents.

The invention claimed is:

1. A dispenser container having a retractable nozzle, the container comprising:

a container body (10);

a locking cap (20) coupled to an upper portion of the container body;

an air pumping part (30) coupled and secured to the upper portion of the container body by the locking cap (20), and configured to discharge contents;

a guide cap (40) coupled to an upper portion of the locking cap (20) at a location outside the locking cap and configured to be movable up and down, and having an upper portion provided with a guide protrusion (41) formed helically;

a nozzle cap (50) coupled to an upper portion of the guide cap (40) at a location outside the guide cap and configured to pressurize and operate the air pumping part while being rotated and being moved up and down in conjunction with the guide cap, and including a vertical discharge hole (51) centrally formed therein and a nozzle coupling hole (52) horizontally extending from one side of an upper portion of the vertical discharge hole to be in communication therewith; and a nozzle (60) inserted into the nozzle coupling hole (52) of the nozzle cap, having a lower portion provided with a guide groove (61) to which the guide protrusion (41) of the guide cap is inserted, and configured to be extended out of and retracted into the nozzle coupling hole of the nozzle cap in a guide operation by rotation of the nozzle cap, the nozzle including a nozzle hole (62) horizontally formed therein and a through-hole (63) vertically extending from an inner lower portion of the horizontal nozzle hole to be in communication therewith so that during extension of the nozzle, the through-hole (63) is moved from an offset position to an aligned position with respect to the vertical discharge hole (51) of the nozzle cap, thereby allowing the contents to be discharged, and during retraction of the nozzle, the through-hole (63) is moved from the aligned position to the offset position with respect to the vertical discharge hole (51) of the nozzle cap, thereby blocking discharge of the contents, wherein a stepped recess (53) is formed above the vertical discharge hole (51) of the nozzle cap (50), and a sealing sheet (55) having an auxiliary vertical discharge hole (56) formed at a position corresponding to the vertical discharge hole (51) is inserted into the stepped recess (53) to be in tight contact with the through-hole (63) of the nozzle thereby providing a seal of the through-hole.

2. The container of claim 1, wherein the nozzle cap (50) comprises an outer cap (50A), and an inner cap (50B) configured such that the vertical discharge hole (51) and the stepped recess (53) are centrally formed in an upper portion thereof and a nozzle coupling groove (52') is formed at one side thereof; and the nozzle cap is configured such that the outer and inner caps are separately provided from each other and the outer cap is coupled to the inner cap with the nozzle and the sealing sheet being coupled to the upper portion of the inner cap.

3. The container of claim 1, wherein the container body (10) comprises an inner cylinder (11) in which the contents are stored and an outer cylinder (12) fitted over an outer surface of the inner cylinder (11), and the container body is configured such that the inner and outer cylinders are coupled to each other to be rotatable with respect to each other, wherein a guide pin (11*a*) protrudes from an upper portion of an outer surface of the inner cylinder (11), and an inclined guide path (12*a*) along which the guide pin is guided is circumferentially formed on an inner surface of the outer cylinder (12) so that when the inner cylinder is moved up or down in response to rotation of the outer cylinder, the nozzle cap (50) is moved with respect to an upper portion of the outer cylinder (12) from a spaced-apart position to a seated position or from the seated position to the spaced-apart position, thereby allowing the nozzle cap to come into a pressable state or a non-pressable state.

* * * * *